US009737763B2

(12) United States Patent
Fujimoto

(10) Patent No.: US 9,737,763 B2
(45) Date of Patent: Aug. 22, 2017

(54) SWIM FIN

(71) Applicant: TABATA CO., LTD., Tokyo (JP)

(72) Inventor: Takashi Fujimoto, Tokyo (JP)

(73) Assignee: TABATA CO., LTD., Tokyo (JP)

( * ) Notice: Subject to any disclaimer, the term of this patent is extended or adjusted under 35 U.S.C. 154(b) by 0 days.

(21) Appl. No.: 15/333,211

(22) Filed: Oct. 25, 2016

(65) Prior Publication Data

US 2017/0120110 A1 May 4, 2017

(30) Foreign Application Priority Data

Nov. 2, 2015 (JP) ..... 2015-215432

(51) Int. Cl.
*A63B 31/08* (2006.01)
*A63B 31/11* (2006.01)

(52) U.S. Cl.
CPC ..... *A63B 31/11* (2013.01); *A63B 2031/112* (2013.01)

(58) Field of Classification Search
CPC ..... A63B 31/11
See application file for complete search history.

(56) References Cited

U.S. PATENT DOCUMENTS 5,108,327 A * 4/1992 Klein ..... A63B 31/11 441/62
5,292,272 A * 3/1994 Grim ..... A63B 31/11 441/62
5,324,219 A 6/1994 Beltrani et al.
5,632,662 A * 5/1997 Cadorette ..... A63B 31/11 441/63
5,766,050 A * 6/1998 Maggi ..... A43B 3/00 441/63
6,129,601 A * 10/2000 Aucoin ..... A63B 31/11 441/64
6,247,982 B1 * 6/2001 Walker ..... A63B 31/11 441/64
7,462,085 B2 * 12/2008 Moyal ..... A63B 31/11 441/64
8,678,870 B2 * 3/2014 Johnson ..... A63B 31/12 441/60
2005/0153607 A1 * 7/2005 Burns ..... A63B 31/11 441/63
2011/0065343 A1 * 3/2011 Hsu ..... A63B 31/11 441/63

FOREIGN PATENT DOCUMENTS

JP 06-054927 3/1994

* cited by examiner

*Primary Examiner* — Stephen Avila
(74) *Attorney, Agent, or Firm* — Clark & Brody

(57) ABSTRACT

A swim fin includes a blade and a foot pocket separate from the blade that can be coupled and released. The blade extends in a rearward direction Y2 at both side portions of a rear end of the blade, and has both coupling arms spaced apart in a lateral direction X and both first transverse engaging portions positioned on mutually faced inner surfaces of both coupling arms. A first intermediate engaging portion is positioned between both transverse engaging portions. The foot pocket has both second transverse engaging portions positioned on both side portions of a front end of the foot pocket and detachably engaged with both first transverse engaging portions. A second intermediate engaging portion is detachably engaged with the first intermediate engaging portion.

7 Claims, 7 Drawing Sheets

SWIM FIN

BACKGROUND OF THE INVENTION

The present invention relates to swim fins to be worn for diving and swimming.

RELATED ART

Conventionally, swim fins are known having an integrated blade and foot pocket and swim fins having a blade and foot pocket formed separately and then coupled. As an example of a swim fin of the latter fins, Japanese Patent Application Laid-open Publication No. Hei 6-54927 discloses a swim fin having a blade and foot pocket detachably coupled by a coupling means.

The swim fin disclosed in Japanese Patent Application Laid-open Publication No. Hei 6-54927 is easy to retract and carry because the blade and foot pocket is detachably coupled by snap-engaging. Moreover, it reduces costs because it is possible to replace either one of the blade or the foot pocket when broken.

SUMMARY OF THE INVENTION

However, the blade and foot pocket being coupled by snap-engaging only, may be detached when a coupling portion stricks against a reef or is subjected to external force in a lateral direction such as detach the blade and foot pocket underwater or where else.

An object of the present invention is to improve the conventional swim fin, and to provide a swim fin having a blade and a foot pocket that can be coupled and decoupled, wherein the coupling is stable and assured at a central portion and both side portions in the lateral direction.

A swim fin of the present invention has frontward and rearward directions and a lateral direction, and includes a blade, and a foot pocket separate from the blade. The blade extends in the rearward direction at both side portion of a rear end of the blade, and has both coupling arms spaced apart in the lateral direction, both first transverse engaging portions positioned on mutually facing inner surfaces of both coupling arms, and a first intermediate engaging portion positioned between both transverse engaging portions. The foot pocket has both second transverse engaging portions positioned on both side portions of a front end of the foot pocket and detachably engaged with both first transverse engaging portions, and second intermediate engaging portion detachably engaged with the first intermediate engaging portion. A first engagement of the first intermediate engaging portion and the second intermediate engaging portion, and a second engagement and a third engagement of both first transverse engaging portions are retained by a fastening element that is extractably and removably passed in the lateral direction through the second engagement and the third engagement.

In the specification, the term 'engagement' refers to a mechanical entanglement of one portion (or element) with another portion (or element), and such state being retained. Typically, it refers to a projection being detachably entangled with a recess, a groove (bottomed or bottomless), a stage portion or a similar portion thereof, and such state being retained unless an external force is applied.

With the swim fin according to one or more embodiments of the present invention, since the first and the second intermediate engaging portions are engaged mutually, both first transverse engaging portions and both second transverse engaging portions are engaged mutually, or in other words, the three sites are engaged mutually, and moreover, are retained by the fastening element that is passed through each engaging portion of the blade and the foot pocket, the blade and the foot pocket are detachably coupled stably and assuredly. Consequently, even when an external force is exerted by an impact from any direction during the use of the swim fin, there is no possibility that the coupling between the plate and the foot pocket is detached from each other inadvertently. Moreover, the blade and foot pocket in mutually separated compact state can be easily housed and carried in a bag, and it is possible and easy to replace the blade and pocket, thereby enabling to reduce the maintenance cost for the swim fin. Consequently, the swim fin according to the present invention is well suited for actual use such as swimming and diving.

BRIEF DESCRIPTION OF DRAWINGS

The drawings illustrate specific embodiments of the present invention including optional and preferred embodiments as well as essential features of the invention.

DESCRIPTION OF THE EMBODIMENTS

The embodiments described below relate to a swim fin 10 illustrated in FIG. 1 to FIG. 7, including both optional and preferred features as well as those features which are essential features of the present invention.

Figure 1:
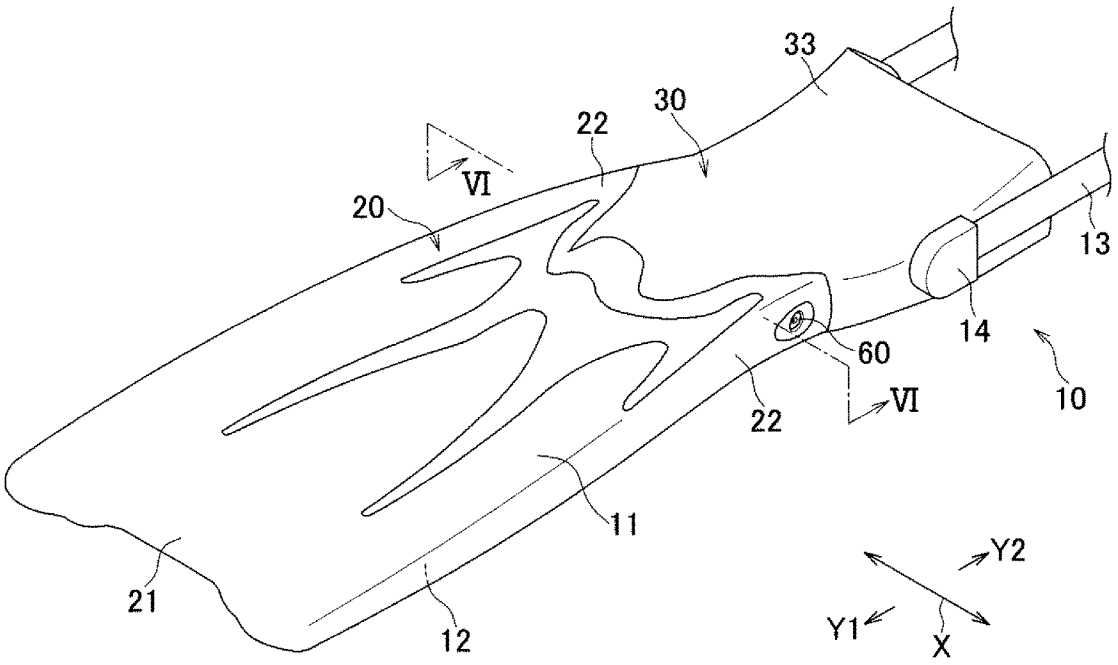
FIG. 1 is a perspective view when a swim fin according to present invention is viewed from an upper side.

Referring to FIG. 1, a swim fin 10 has frontward and rearward directions Y1 and Y2, a lateral direction X, an upper surface 11 and a lower surface 12, and includes a blade 20, a foot pocket 30, and a heel strap 13 attached to both sides 32 through a buckle and preferably formed of flexible elastic materials. The heel strap 13 is detachably attached to the foot pocket 30 such that a length thereof can be adjusted by the buckle 14 made of hard plastic materials in order to enable to tighten preferably to the heel of a wearer. Although not shown, the foot pocket 30 has an anti-slip projection pattern on the lower surface 12 thereof.

<Blade>

Figure 2:
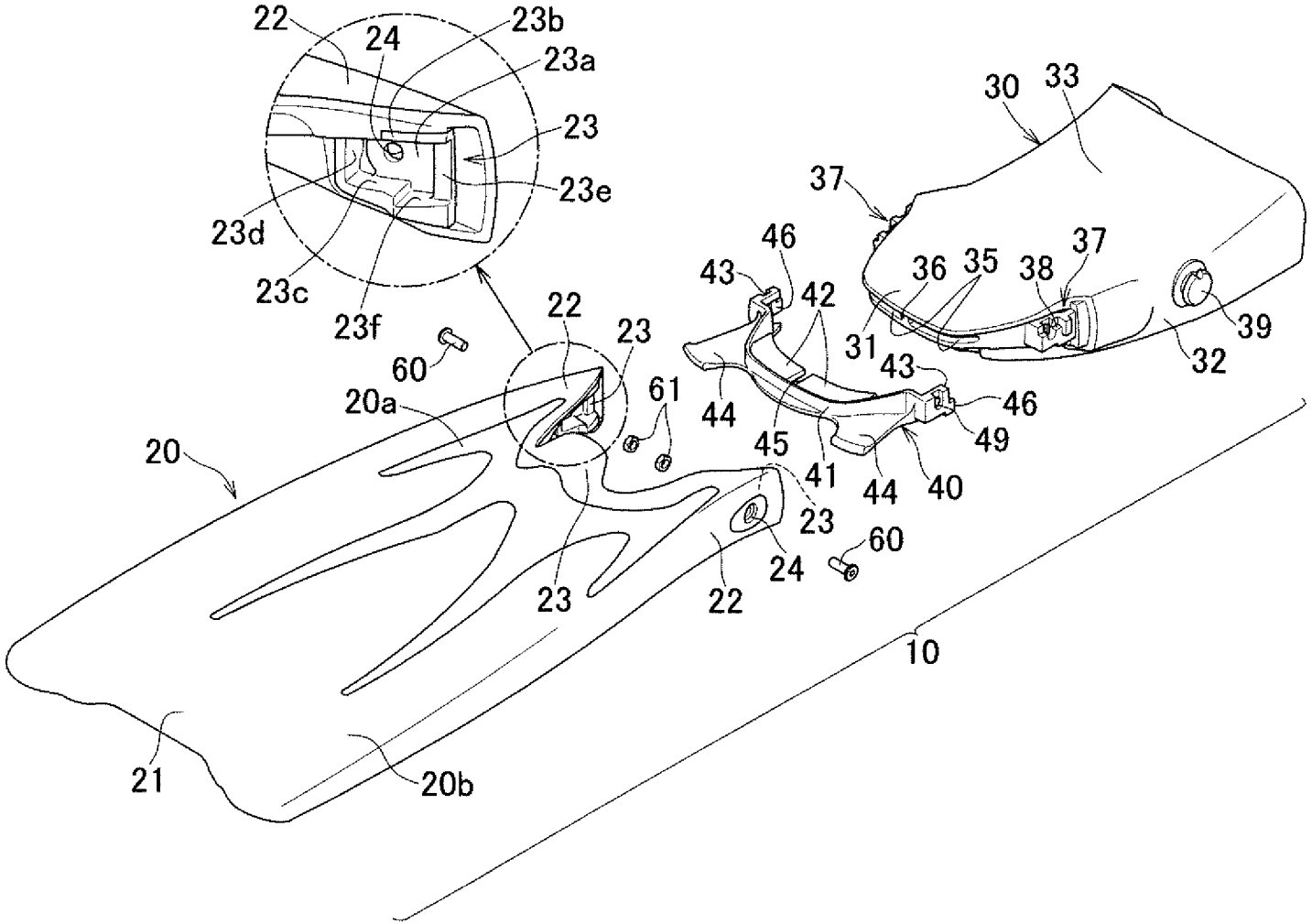
FIG. 2 is an exploded perspective view of the swim fin disassembled into a blade, a foot pocket, and a coupler plate.
Figure 3:
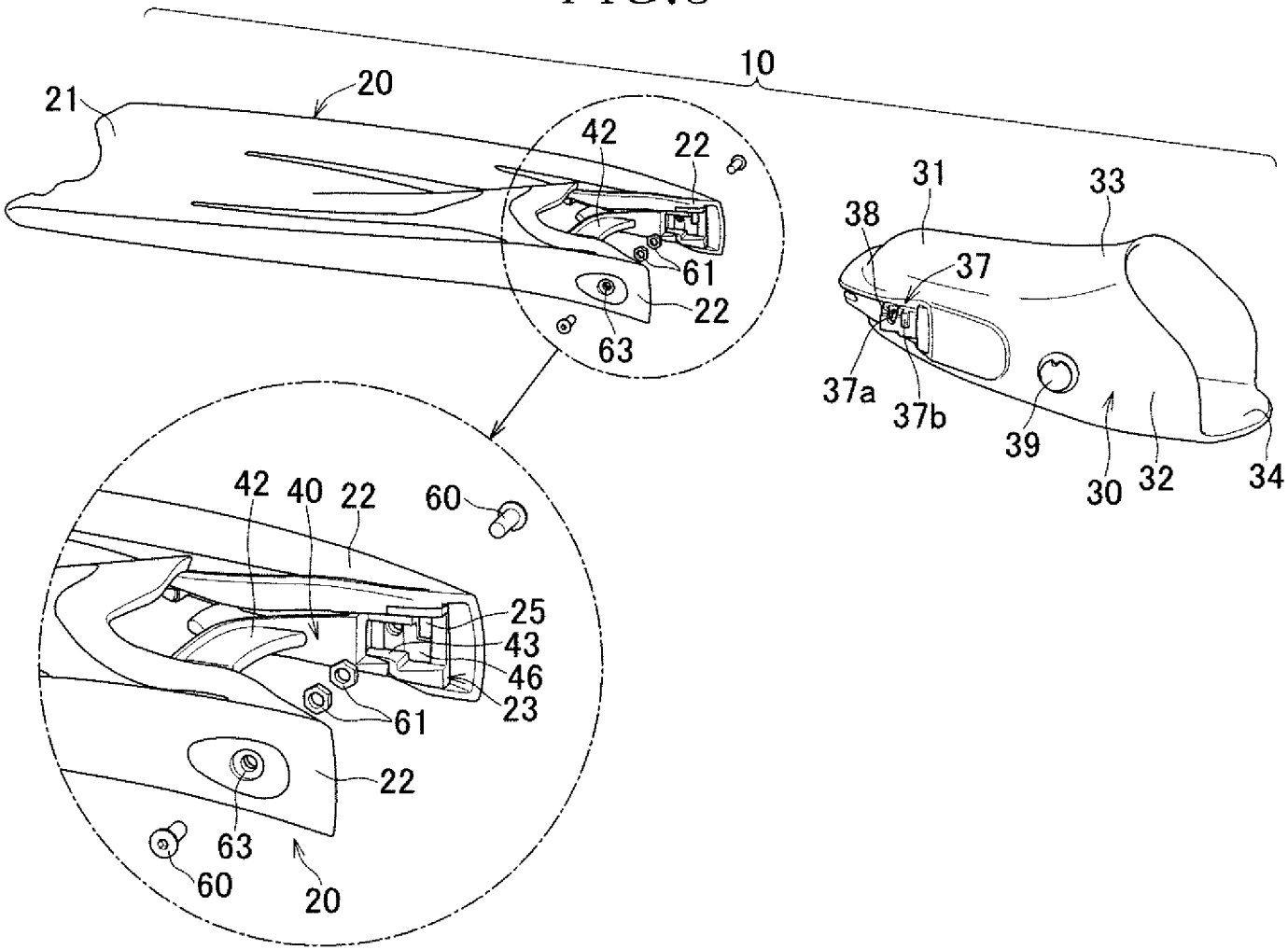
FIG. 3 is an exploded perspective view of the swim fin disassembled into the blade and the foot pocket.

Referring to FIG. 2 and FIG. 3, the blade 20 includes a coupler plate 40. The blade 20 has a front end portion 21, and both coupling arms 22 at a rear end portion. The coupling arms 22 extend in the rearward direction Y2 from a main body portion of the blade 20, spaced apart from each other in the lateral direction X. Each coupling arm 22, in an inner side surface of a rear end thereof, has an engaging groove 23 as a first lateral engaging portion preferably formed of hard plastic materials. Each engaging groove 23 is defined by a bottom surface 23*a*, upper and lower side projection edges 23*b* and 23*c*, a front end projection edge 23*d*, a rear end projection edge 23*e* lower than the edges 23*b*, 23*c*, and 23*d*, and a staged projection edge 23*f* in continuity with the lower side projection edge 23*c*. A guide hole 24 of a fastening element to be described later is positioned in the bottom surface 23*a*.

The blade 20 has hard portions having rib shapes formed of hard plastic materials such as acrylic and polycarbonate, and a soft portion formed of relatively soft rubber having rubber elasticity or soft plastic materials such as silicon and polyurethane, disposed in a balanced manner. By disposing the hard portions and the soft portion to be well balanced in such manner, while the soft portion is deformed in response to a movement of the foot of a diver, the hard portions are not deformed in response to the movement of the foot, thereby making it possible to exert a constant driving force when kicked.

Referring to FIGS. 2 to 5, the coupler plate 40 is preferably formed of hard plastic materials, and has a rib 41 having upper and lower edges 41*a* having a flange function, curved to be projected toward the frontward direction Y1, a pair of engaging plugs 42 in the form of a pair of plates as first intermediate engaging portions projected in the rearward direction Y2 from a rear side surface of the rib 41, a rear end engaging portion 43 having an L-shape in a plan view of the rib 41, and auxiliary protrusions 44*a* in continuity with rear end portion of a pair of supporting arms 44 in the form of a plate projected in the frontward direction Y1 of both side portions of the rib 41, and a central space 45 is positioned between both engaging plugs 42. The rear end engaging portion 43 has an engaging protrusion 46 at a lower side corner of a rear end thereof, an upper side engaging edge 47, and a lower side engaging edge 48. The rear end engaging portion 43 has a guide hole 49 of the fastening element to be described later. Each engaging plug 42 has a curved edge 42*a* aligning with an inner side curved surface of the front end portion to be described later of the foot pocket 30.

The coupler plate 40 is to be fixed between both coupling arms 22 of the blade 20. In a fixed state, the rear end engaging portion 43 of the coupler plate 40 is detachably engaged in a space defined by the bottom surface 23*a*, the upper and lower side projection edges 23*b* and 23*c*, and the front end projection edge 23*d* of the coupling arm 22, the engaging protrusion 46 of the coupler plate 40 is detachably engaged in a space defined by the upper side projection edge 23*b* and the staged-projection edge 23*f* of the engaging groove 23 in the coupling arm 22, and the auxiliary protrusions 44*a* make contact with the lower side projection edge 23*c* of the engaging groove 23 in the coupling arm 22. In a state of the blade 20 and the coupler plate 40 engaged in this manner, in the engaging groove 23, an engaging recess 25 with which an engaging protrusion 37 to be described later of the foot pocket 30 is detachably engaged, is defined.

The coupler plate 40, as an illustrated embodiment may be formed separately from the blade 20, and may be integrally fixed to the blade 20 in advance, or, unlike the illustrated embodiment may be not formed integrally with the blade 20. When the swim fin 10 is formed in such manner, it is possible to save time and trouble for fixing the coupler plate 40 to the blade 20.

Figure 5:
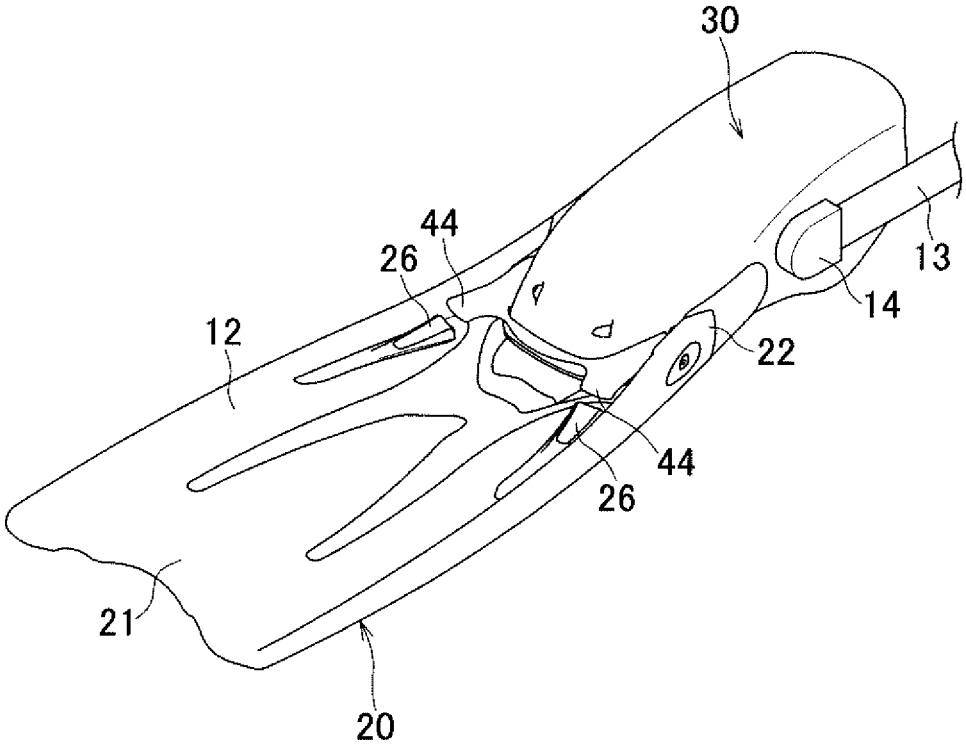
FIG. 5 is a perspective view when the swim fin is viewed from a lower side.
Figure 6:
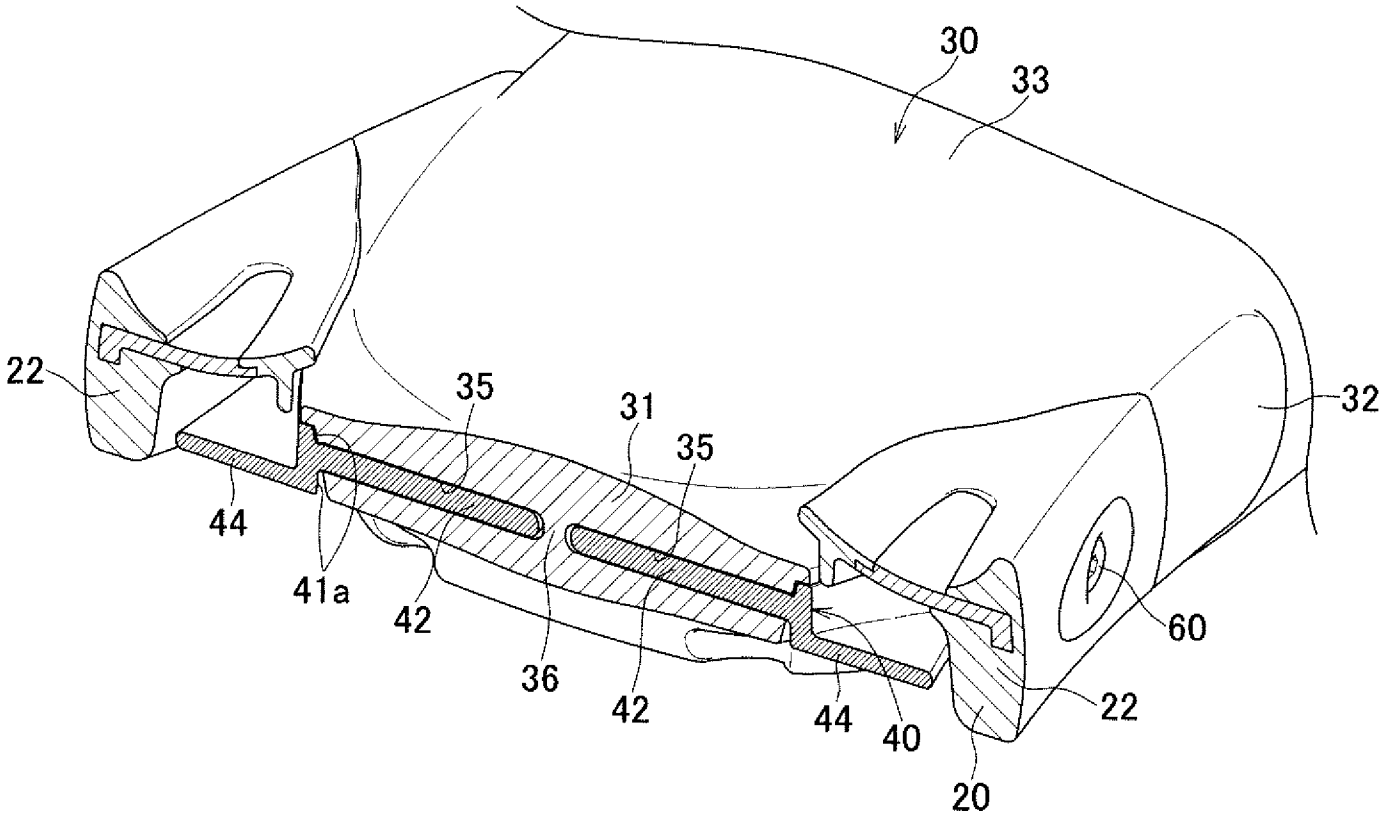
FIG. 6 is a cross-sectional perspective view along line VI-VI in FIG. 1.

Referring to FIG. 5, a pair of bumps 26 inclined downward in the frontward direction is formed on the lower surface 12 near the rear end portion of the blade 20. Both bumps 26 are spaced by an appropriate distance in the frontward and rearward directions Y1 and Y2 and a thickness direction of the blade 20 and the supporting arm 44 of the coupler plate 40. Consequently, when the wearer has down-kicked in water, by the blade 20 being bent toward the lower surface 12 thereof due to a resistance of water, both bumps 26 abut with the supporting arm 44. As a result, since the bending of the blade 20 is regulated, a water flow is generated by making the blade 20 bend appropriately, thereby enabling to achieve the propulsive force efficiently.

<Foot Pocket>

Referring to FIGS. 2, 4*a*, and 4*b*, the foot pocket 30 has a front end portion 31 extending to be convex toward the frontward direction Y1, both side portions 32, a top portion 33, and a bottom portion 34. Protrusion 39 to be detachably engaged with an engaging hole (not shown) of the buckle 14 is positioned on both side portions 32 of the foot pocket 30. The foot pocket 30 has on an edge surface of the front end portion 31 thereof, a pair of engaging slots 35 as both intermediate engaging portions, and a central partition wall 36 (refer to FIG. 6) detachably engaged with the central space 45 of the coupler plate 40, and positioned between both engaging slots 35. The foot pocket 30 has the engaging protrusion 37 as a second transverse engaging portion positioned on both side surfaces of the front end portion 31, so as to be detachably engaged with the rear end engaging portion 43 of the coupler plate 40. The engaging protrusion 37 has a portion 37*a* to be engaged between the upper and lower side projection edges 23*b* and 23*c* of the engaging groove 23 of the blade 20, and an engaging projection 37*b* to be detachably engaged with the engaging recess 25 positioned in an area of the engaging groove 23 of the blade 20. A nut 61 is fixed in the engaging protrusion 37.

In the foot pocket 30, a portion extending from the front end portion 31 up to the engaging protrusion 39 is a hard portion formed of hard plastic materials such as an ABS (acrylonitrile butadiene styrene) resin and a polycarbonate resin, and a portion other than this is a soft portion formed of rubber or soft plastic materials. At least part of an outer surface of the hard portion is covered by the same material same as the soft portion.

Figure 4:
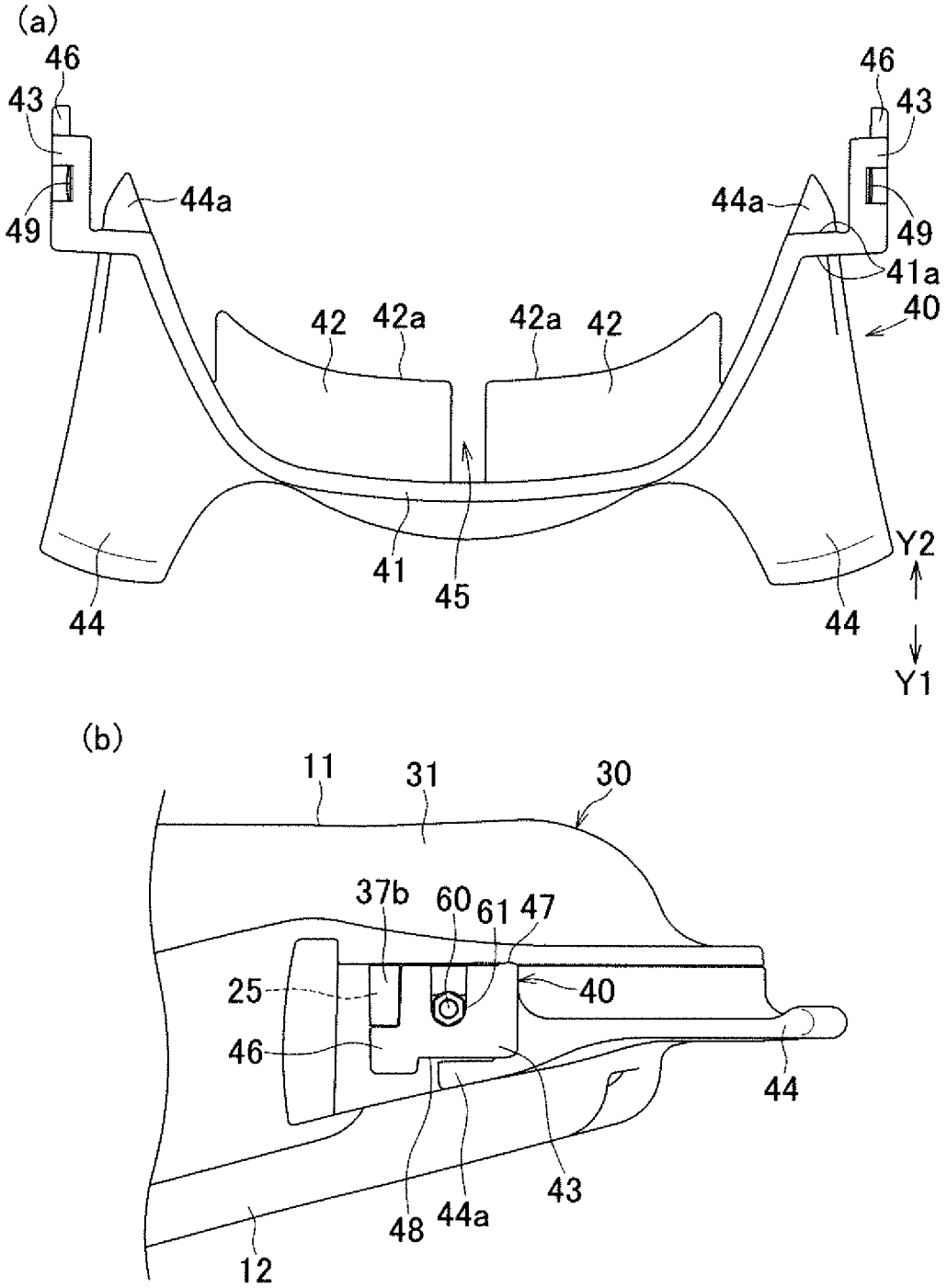
FIG. 4 (*a*) is a plan view of the coupler plate, and FIG. 4 (*b*) is a side view of the coupler plate in a state of a first and second transverse engaging portions engaged mutually.

According to the swim fin 10 according to the embodiment of the present invention, coupling and detaching of the blade 20 and the foot pocket 30 is carried out by the following operation (refer to FIGS. 2 to 4). The front end portion 31 of the foot pocket 30 is faced with the coupler plate 40 positioned on the blade 20, and the central partition wall 36 of the foot pocket 30 is engaged with the central space 45 of the coupler plate 40, the pair of engaging slots 35 of the foot pocket 30 is engaged with the pair of engaging plugs 42 of the coupler plate 40, and the upper and lower edges 41*a* of the rib 41 of the coupler plate 40 is engaged by pressing till abutting with an edge surface of the front end portion 31 of the foot pocket 30. At the same time, the portion 37*a* of the engaging protrusion 37 of the foot pocket 30 is engaged between the upper and lower side projection edges 23*b* and 23*c* of the coupler plate 40, and the engaging projection 37*b* of the foot pocket 30 is engaged with the engaging recess 25 positioned in the engaging groove 23 of the blade 20. In such state of engagement of the blade 20 and the foot pocket 30, a series of guide holes 63 is formed in the blade 20 by guide holes 38 in the foot pocket 30 of the coupler plate 40 communicating. A bolt 60 as a fastening element is passed through the guide hole 63, and a front end thereof is screwed into the nut 61 as a counterpart of the fastening element positioned in the engaging protrusion 37 of the foot pocket 30. Such coupling of the blade 20 and the foot pocket 30 is detached from each other by removing the engaging projection 37*b* in the foot pocket 30 from the engaging recess 25 in the coupling arm 22 by slightly expanding both coupling arms 22 of the blade 20 resisting the rubber elasticity, after the bolt 60 is removed from the nut 61, and then removing the engaging slots 35 in the foot pocket 30 from the engaging plugs 42 of the blade 20.

Figure 7:
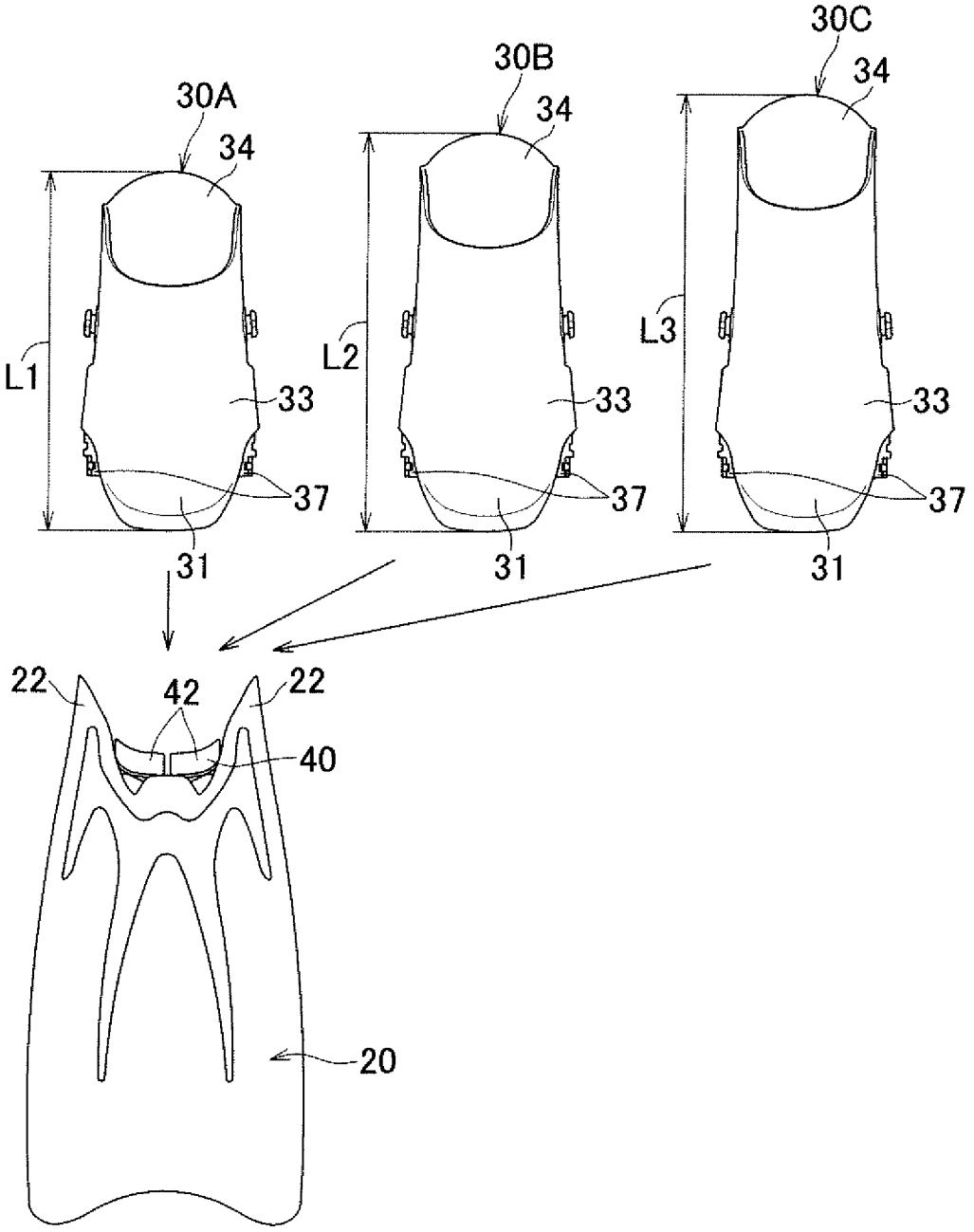
FIG. 7 is an exploded plan view of a swim fin according to one of embodiments.

Referring to FIG. 7, this is an exploded plan view of one blade 20 and a plurality of foot pockets, namely, first to third foot pockets 30A to 30C to be detachably coupled to the blade 20 illustrating one of examples of the swim fin 10. A dimension in the lateral direction X of the front end portion 31 of the first to third foot pockets 30A to 30C is the same, whereas a linear dimension (dimension in the frontward and rearward directions Y1 and Y2) L1 to L3 thereof and a linear dimension of the top portion 33 differ. Specifically, a correlation of the linear dimensions L1 to L3 of the first to third foot pockets 30A to 30C is the linear dimension L3 of the third foot pocket 30C>the linear dimension L2 of the second foot pocket 30B>the linear dimension L1 of first foot pocket 30A.

In such manner, in the swim fin 10, as it is possible to use by coupling the foot pockets 30A to 30C of a plurality of different sizes with one blade 20, the swim fin 10 has a superior size adaptability, and for instance, since a plurality of family members having different foot size may use one blade 20 in common, it has a superior portability and also it is possible to facilitate reduction in cost.

The features of the swim fin according to the present embodiments may be arranged as follows:

The swim fin of the present invention has frontward and rearward directions and a lateral direction, and includes a blade, and a foot pocket separate from the blade. The blade extends in the rearward direction at both side portions of a rear end of the blade, and both coupling arms spaced apart in the lateral direction, both first transverse engaging portions positioned on mutually facing inner surfaces of both coupling arms, and a first intermediate engaging portion positioned between both transverse engaging portions. The foot pocket has both second transverse engaging portions positioned on both side portions of a front end of the foot pocket and detachably engaged with both first transverse engaging portions, and a second intermediate engaging portion detachably engaged with the first intermediate engaging portion. A first engagement of the first intermediate engaging portion and the second intermediate engaging portion, and a second engagement and a third engagement of both first transverse engaging portions are retained by a fastening element that is extractably and removably passed in the lateral direction through the second engagement and the third engagement.

The present invention includes the following embodiments, and these embodiments may be taken in isolation or in combination with one another.

(1) The first intermediate engaging portion is a pair of engaging plugs, and a central space is positioned between the pair of engaging plugs, and the second intermediate engaging portion is a pair of engaging slots detachably engaged with the pair of engaging plugs, and a central partition wall detachably engaged with the central space is positioned between the pair of engaging slots.

(2) The first transverse engaging portion is an engaging groove, and the second transverse engaging portion is an engaging projection detachably engaged with the first transverse engaging portion.

(3) The engaging groove has an engaging recess in an area thereof, and the engaging protrusion has an engaging projection detachably engaged with the engaging recess.

(4) A coupler plate is integrally interposed between both coupling arms, and the coupler plate has a pair of engaging plugs.

(5) The blade, on a rear surface near a rear end portion thereof, has a pair of bumps inclined downward in the frontward direction, and the coupler plate has a pair of supporting arms abutting with the pair of bumps when the blade is curved toward a lower surface side thereof due to a resistance of water when the swim fins are being used.

(6) The fastening element is a bolt, and a nut through which the bolt is to be screwed is fixed to the engaging protrusion of the foot pocket.

For component members forming the swim fin 10, known materials of various types being used commonly other than the materials described in the present specification may be used without restriction unless specified. Moreover, the terms 'first' and 'second' used in the specification and claims are used to distinguish similar elements and positions etc.

REFERENCE SIGNS LIST

10 swim fin
20 blade
22 coupling arm
23 engaging groove (first transverse engaging portion)
25 engaging recess
30 foot pocket
35 engaging slot (second intermediate engaging portion)
36 central partition wall
37 engaging protrusion (second transverse engaging portion)
37*a* portion to be engaged
37*b* engaging projection
40 coupler plate
42 plugs(first intermediate engaging portion)
44 supporting arm
45 central space
60 bolt
61 nut
X lateral direction
Y1 frontward direction
Y2 rearward direction

What is claimed is:

1. A swim fin having frontward and rearward directions and a lateral direction, comprising:

a blade; and a foot pocket separate from the blade, wherein the blade extends in the rearward direction at both side portions of a rear end of the blade, and has both coupling arms spaced apart in the lateral direction, both first transverse engaging portions positioned on mutually faced inner surfaces of both coupling arms, and a first intermediate engaging portion positioned between both first transverse engaging portions, and the foot pocket has both second transverse engaging portions positioned on both side portions of a front end of the foot pocket and detachably engaged with both first transverse engaging portions, and a second intermediate engaging portion detachably engaged with the first intermediate engaging portion, and a first engagement of the first intermediate engaging portion and the second intermediate engaging portion, and a second engagement and a third engagement of both first transverse engaging portions are retained by a fastening element that is extractably and removably passed in the lateral direction through the second engagement and the third engagement.

2. The swim fin according to claim 1, wherein the first intermediate engaging portion is a pair of engaging plugs, and a central space is positioned between the pair of engaging plugs, and the second intermediate engaging portion is a pair of engaging slots detachably engaged with the pair of engaging plugs, and a central partition wail detachably engaged with the central space is positioned between the pair of engaging slots.

3. The swim fin according to claim 1, wherein the first transverse engaging portion is an engaging groove, and the second transverse engaging portion is an engaging protrusion detachably engaged with the first transverse engaging portion.

4. The swim fin according to claim 1, wherein the engaging groove has an engaging recess in an area thereof, and the engaging protrusion has an engaging projection detachably engaged with the engaging recess.

5. The swim fin according to claim 1, wherein a coupler plate is integrally interposed between both coupling arms, and the coupler plate has a pair of engaging plugs.

6. The swim fin according to claim 1, wherein the blade, on a rear surface near a rear end portion thereof, has a pair of bumps inclined downward in the frontward direction, and the coupler plate has a pair of supporting arms abutting with the pair of bumps when the blade is curved toward a lower surface side thereof due to a resistance of water when the swim fins are being used.

7. The swim fin according to claim 1, wherein the fastening element is a bolt, and a nut through which the bolt is to be screwed is fixed to the engaging protrusion of the foot pocket.

* * * * *